United States Patent [19]

Liscio

[11] 4,439,060

[45] Mar. 27, 1984

[54] MARINE CIRCULATOR

[76] Inventor: Mary A. Liscio, 133 Brewery Rd., New City, N.Y. 10956

[21] Appl. No.: 319,364

[22] Filed: Nov. 9, 1981

[51] Int. Cl.[3] ..... E02B 15/02

[52] U.S. Cl. ..... 405/61; 405/52

[58] Field of Search ..... 405/22, 52, 61, 62, 405/74; 366/264, 343; 114/140, 331, 121

[56] References Cited

U.S. PATENT DOCUMENTS

| | | | |
|---|---|---|---|
| 1,800,976 | 4/1931 | Andrews | 114/331 |
| 2,991,622 | 7/1961 | Oster | 405/61 |
| 3,063,395 | 11/1962 | Brown | 114/331 |
| 3,083,538 | 4/1963 | Gross | 405/61 |
| 3,221,503 | 12/1965 | Wilson | 405/22 |
| 3,365,178 | 1/1968 | Bood | 405/52 X |
| 4,051,810 | 10/1977 | Breit | 405/52 X |
| 4,247,261 | 1/1981 | Springston | 405/61 X |

*Primary Examiner*—Ernest R. Purser
*Assistant Examiner*—Beverly E. Hjorth
*Attorney, Agent, or Firm*—Weinstein & Sutton

[57] ABSTRACT

A cylindrical housing with either substantially straight or with inwardly tapering sidewalls is formed with a bottom portion that either tapers or curves inwardly until it meets a flat bottom area. A bracing section is connected within the housing to support a motor with fan or propeller blades operated thereby below the open top of the housing and above the bottom portion thereof. A plurality of openings are formed around and through the side wall above the bottom portion but below the motor so that when the housing is disposed in a body of water, and the motor operated, water from within the housing is directed upwardly to the surface of the body of water and additional water is drawn into the housing through the openings of the housing sidewall.

5 Claims, 3 Drawing Figures

FIG. 1
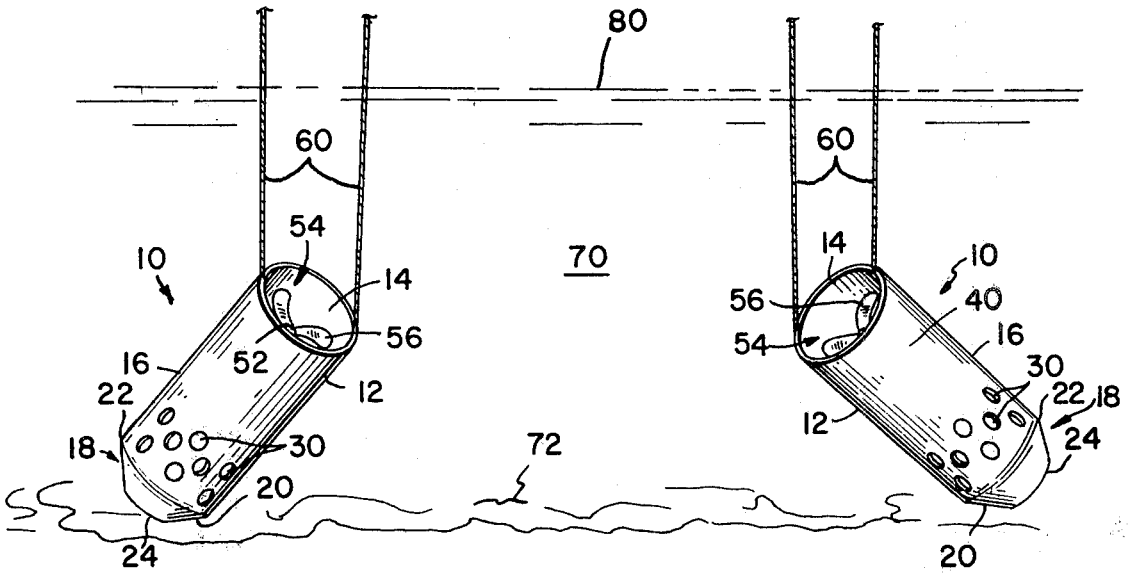
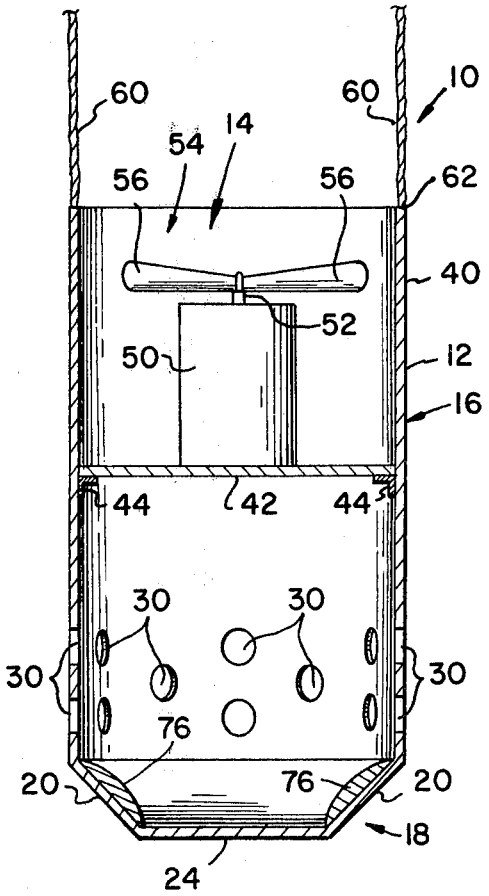
FIG. 2
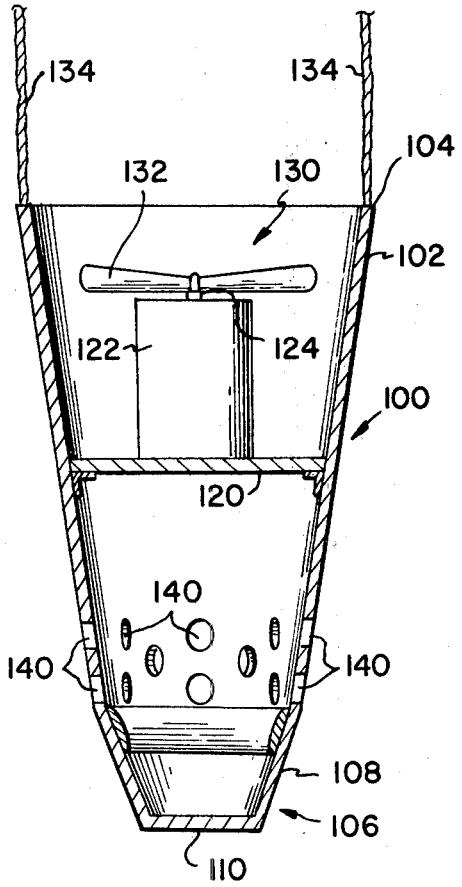
FIG. 3

MARINE CIRCULATOR

BACKGROUND OF THE INVENTION

1. Field of Application

This invention relates to mechanisms for directing a stream of fluid from one level to another level in a body of the fluid or along the surface thereof; and more particularly to mechanisms for propelling the warmer water, located at the lower level in a body of water subject to cold and freezing temperatures, to move to the surface thereof to eliminate or minimize the formation of ice on said body of water or otherwise moving debris, oil slicks, or aerating water to encourage marine growth or circulate water to discourage marine growth.

2. Description of the Prior Art

Streams, rivers, lakes, ponds and similar bodies of water tend to freeze over in freezing weather. The ice thus formed not only impedes commercial shipping, and the use of pleasure craft, but also renders it impossible to park water craft, boats and ships at dockside, where ice will form easier and quicker in the still water, than in the channels kept open by moving ships and boats.

The tendency of the surface to freeze over, especially at marinas where pleasure craft are docked, has resulted in the damage of docks and pilings as well as the removal of many such craft from the water for land storage during cold winter seasons. This is an expensive operation requiring costly equipment and large quantities of land storage area. In addition, taking a boat out of the water and subsequent land storage is not always best for the boat. Alternatively, some marina's and docking areas utilize aeration systems to bubble or otherwise increase the air content of the water, or keep the water moving in attempts to eliminate ice once formed; or to prevent formation thereof. These systems, however, have proved costly and are not always as effective as is necessary.

One type of system for dealing with this problem utilizes equipment which is either partially or fully submerged in the body of water to move water from the lower levels thereof towards the upper level thereof. Such systems rely upon the theory that in such a body of water subject to cold or freezing temperature the water near or at the bottom is at a temperature warmer than freezing. When such warmer water is moved to the top of the body of water it will form a layer thereover and minimize or prevent the formation of ice on the body of water to damage to docks, pilings, and water craft. Thus, boats and ships can remain at dockside throughout the winter.

In systems such as the one shown in U.S. Pat. No. 2,827,268 granted to G. A. Staaf on Mar. 18, 1958 for Liquid Transporting Apparatus the use of a vertical tube, for directing the flow of lower level liquid to the surface of the body of liquid, not only constitutes an expensive structure but also can easily become an obstruction to the movement of ships and boats in the water.

Other available systems, such as shown in U.S. Pat. No. 3,109,288 granted to G. E. Gross on Nov. 5, 1963 for Oscillating and Aerating Ice and Water Control and in U.S. Pat. No. 4,104,526 granted on Mar. 29, 1977 to R. A. Cramer, Jr. for liquid Moving And Mixing Apparatus are not only quite complex in construction and operation but also have fan or propeller blades which are unshielded and can injure or kill fish and other water life.

Still other commercially available mechanisms such as shown in U.S. Pat. No. 3,083,538 granted to G. E. Gross on Apr. 2, 1963 for Apparatus For Maintaining A Body of Water Free of Ice, and like mechanisms, require either permanent or semi-permanent disposition of the device into the material at the waters bottom. As such there may be a tendency to suck up silt and dirt from the bottom beneath the body of water. This will cloud and dirty the water and foul the equipment. In addition, if the intake openings become clogged the mechanism will not perform its intended function.

SUMMARY OF THE INVENTION

It is therefore an object of this invention to provide a new and improved fluid circulator.

It is another object of this invention to provide a new and improved fluid circulation for disposition proximate the lower levels of a body of water.

It is yet another object of this invention to provide a new and improved fluid circulation for disposition proximate the bottom of a body of water to direct the water from said bottom towards the surface thereof.

It is yet still another object of this invention to provide a new and improved fluid circulator for marine uses to direct the warmer water from the lower levels of a body of water subject to cold temperatures towards the surface thereof.

It is yet still a further object of this invention to provide a new and improved marine circulator for use in lakes, ponds, rivers, or the like to direct the water from proximate the bottom thereof towards the surface to eliminate or prevent ice from forming thereon in freezing weather.

This invention involves a marine circulator; and contemplates forming the housing thereof open at the top and closed at the bottom with either tapered or rounded bottom edges so that when submerged in a body of water the container will assume an inclined position resting upon a portion of the tapered or rounded edge. A plurality of openings are formed around the circumference of the housing above and in proximity to the tapered or rounded area to permit water to be drawn into the housing by a motor which rotates a suitable fan or propeller blade. The water is then directed through the open top of the housing towards the surface of the body of water. The housing is provided at its bottom with a flat area to permit the housing to assume a vertical position for either use or storage in that position.

Other objects, features, and advantages of the invention in its details of construction and arrangement of parts will be seen from the above, from the following description of the preferred embodiment when considered with the drawing and from the appended claims.

BRIEF DESCRIPTION OF THE DRAWING

In the drawing:

FIG. 1, is a perspective view of a body of water with a plurality of marine circulators, each incorporating the instant invention disposed therein;

FIG. 2, is a vertical section through the marine circulator of FIG. 1 showing details thereof; and FIG. 3, is a vertical section of a marine circulator with a modified housing.

DESCRIPTION OF THE PREFERRED EMBODIMENT

For convenience the invention will be described as applied to a marine circulator housed in a substantially cylindrical housing open at the top and closed at the bottom except for a plurality of openings for the passage of fluid. The housing is shown disposed at a lake bottom near the shore thereof for use in eliminating ice or minimizing the formation thereof in freezing weather. It should be understood, nevertheless, that without departing from the scope of this invention, that the housing can be of any convenient configuration within the scope of the invention and that it can be disposed proximate the bottom of any body of water for directing the water towards the surface thereof.

With reference to FIG. 1 there is generally shown at 10 a marine circulator including a housing 12 of generally basket like configuration. Housing 12 is open at its top 14 and includes a substantially cylindrical side wall 16 closed by a bottom section 18. A first portion 20 of bottom section 18 is formed to taper inwardly from the lower edge 22 of sidewall 16 until it meets a substantially flat bottom portion 24.

A plurality of openings 30 are disposed through sidewall 16 proximate but above first portion 20 of bottom section 18. Openings 30 are disposed completely around the circumference of sidewall 16. Preferably the openings 30 are each two inches in diameter so as to admit water and prevent larger debris from entering the unit.

An upper section 40 (FIGS. 1 and 2) of housing 12 includes a suitably formed motor support brace 42 secured as by welding or threaded fasteners at 44 to sidewall 16 of housing 12. A motor 50 is secured, as by threaded members (not shown) to support brace 42 with its motor shaft 52 in a vertical position. A fan or blade propeller 54 with a number of blades 56 is secured to motor shaft 52. Fan or propeller blades 56 are suitably formed to propel the fluid upwardly as will be hereinafter described.

A pair of cables or lines 60 are connected proximate upper rim 62 of housing 12 to lower same into a body of water 70, which may either be a lake, pond, river, marina or the like. One of the lines 60 can also carry a suitable electrical conductor for providing electrical power to motor 50 from a suitable source of electrical energy (not shown) provided with suitable controls (not shown).

One or more marine circulators 10 can be disposed in body of water 70 so as to sit on the bottom 72 thereof. Either the natural currents of flow of water 70 will rock marine circulators 10 until they rest upon slanted portion 20 of bottom section 18. If desired a weight 76 may be disposed within housing 12 proximate portion 20 to facilitate this. If need be marine circulator 10 may be set upon bottom 72 so as to rest upon portion 20.

When one or more marine circulators are so disposed, and motors 50 thereof energized, the action of motor 50 and blades 56 is such as to propel water 70 within housing 12 upwardly towards the upper surface 80 of water 70. The sidewalls 16 of housing 12 help so direct water 70. As water 70 from within housing 12 is propelled up towards surface 80 of water 70 additional water 70 is drawn into housing 12 through openings 30 and is also propelled towards surface 80 of water 70. This action is continuous and draws the warmer water disposed near bottom 72 up to surface 80 where it layers over colder water when water 70 is subject to cold or freezing weather. As a result, surface 80 does not freeze over and boats or shipping may remain disposed therein, even in a docked condition, throughout winter weather.

When marine circulators 10 are stored out of the water they may be set to rest upon flat bottom portion or area 24. Alternatively, they may be placed in body of water 70 upon flat bottom portion 24 if so desired.

A modified marine circulator 100 is shown in FIG. 3. Circulator 100 includes a sidewall 102 tapered from a top-edge 104 towards a bottom portion 106. Bottom portion 106 includes a bottom section 108 curving inwardly towards a flat area 110.

A bracing section 120 suitable secured within sidewall 102 positions a motor 122 with its motor shaft 124 in a substantially vertical position with respect to flat area 110. A fan or propeller 130 with a plurality of blades 132 is carried by motor shaft 124. Suitable electrical power is provided through suitable controls to motor 122 by a line 134.

A plurality of openings 140 are provided through and around sidewall 102 in the area thereof below motor 122 and above bottom portion 106. If desired, appropriate weighting can be provided within housing 102 proximate curved section 108 to facilitate disposition of marine circulator 100 in an inclined position resting on the outer surface of curved bottom section 108.

Marine circulator 100 operates and coacts with water 70 in the manner described above for marine circulator 10. When marine circulator 100 is stored it can be stored so as to rest upon flat area 110. Marine circulator 100 may also be disposed in body of water 70 so as to rest upon its flat area 110.

From the above description it will thus be seen that there has been provided a novel and improved marine circulator; which marine circulator is simple in construction and operation and is very effective to direct warmer water, from a body of water subject to freezing temperatures, up to the surface of the body of water to eliminate or minimize the formation of ice on said surface.

It is understood that although I have shown the preferred form of my invention that various modifications may be made in the details thereof without departing from the spirit as comprehended by the following claims.

Preferably, the motor 50 or 122 should be located so that the blades are at a point approximately one-half the length of the housing 16 as measured from the top of the openings 30 (closest to the rim 62) to the rim 62. This has been found to provide maximum thrust.

The device is usable for propelling or moving water so as to push debris or oil slicks by locating the rim 62 at or along the surface of the fluid. It may also be disposed at the bottom of a body of water for circulating water without disturbing the bottom or otherwise sucking up bottom materials. The device may also be used for aerating a body of water to encourage marine growth or for circulating water to prevent the growth of marine life.

I claim:

1. A marine circulator comprising:

housing means including substantially continuous cylindrical-shaped wall means of predetermined axial extent and predetermined circumferential size, said housing means being open at a top end thereof and closed at a bottom end thereof by closure means integral with said housing means to prevent entry of water and debris through the bottom end of said closure means;

said closure means including a substantially flat bottom portion of predetermined circumferential size, smaller than the predetermined circumferential size of said cylindrical wall means, and concentrically arranged with respect thereto, and a tapered portion integral with and extending upwardly and outwardly from the periphery of said bottom portion and integrally joined to the lower end of said cylindrical wall means;

mounting means disposed within said housing means intermediate said top and said bottom ends;

fluid moving means;

said wall means being solid and continuous except for a plurality of openings extending through said wall means in the region above said closure means and between said mounting means and said fluid moving means, said openings being arranged about the periphery of said cylindrical wall means in the aforementioned region;

said flat bottom portion adapted to support said circulator upon the bottom surface of a body of water, whereby said openings are displaced from said bottom portion to prevent mud and/or debris from entering said housing means;

flexible cable means coupled to the upper end of said housing means for suspending the marine circulator submerged in a body of water;

said fluid moving means comprising a drive motor carried by said mounting means and a propeller driven by said drive motor and arranged so that when said housing means is disposed in a body of fluid and said drive motor is energized, fluid is drawn into said housing means through said plurality of openings, and the fluid drawn into said housing means is propelled out of said housing means through the top end thereof whereby, when said circulator is submerged in a body of water so that its top end is closer to the surface of the water than said bottom means, water from the lower depths of the body of water is delivered toward the surface of the body of water to alter the temperature of the water in the region of said surface.

2. The marine circulator of claim 1, wherein said propeller is arranged below the top end of said housing means.

3. The marine circulator of claim 1 wherein said housing means, when disposed in a body of fluid, is formed to rest upon said tapered portion of said bottom means such that, when said fluid moving means is energized, it will direct fluid from the bottom of said body of fluid to the top thereof.

4. The marine circulator of claim 1 wherein weighting means are disposed along the interior of said tapered portion of said bottom means to facilitate disposition of said housing means thereon when disposed in a body of fluid.

5. The marine circulator of claim 1 wherein said tapered portion has a curved configuration between said flat bottom portion and said cylindrical-shaped wall means.

* * * * *